US005480677A

United States Patent [19]

Li et al.

[11] Patent Number: 5,480,677

[45] Date of Patent: *Jan. 2, 1996

[54] PROCESS FOR PASSIVATING METAL SURFACES TO ENHANCE THE STABILITY OF GASEOUS HYDRIDE MIXTURES AT LOW CONCENTRATION IN CONTACT THEREWITH

[75] Inventors: Yao-En Li, Buffalo Grove; John Rizos, Frankfort; Gerhard Kasper, Downers Grove, all of Ill.

[73] Assignee: American Air Liquide Chicago Research Center, Countryside, Ill.

[ * ] Notice: The term of this patent shall not extend beyond the expiration date of Pat. No. 5,255,445.

[21] Appl. No.: 338,230

[22] Filed: Nov. 9, 1994

Related U.S. Application Data

[63] Continuation of Ser. No. 215,016, Mar. 21, 1994, abandoned, which is a continuation of Ser. No. 709,183, Jun. 3, 1991, abandoned.

[51] Int. Cl.[6] ..... C23C 16/00; F26B 3/00

[52] U.S. Cl. ..... 427/248.1; 427/239; 427/237; 427/314; 34/443

[58] Field of Search ..... 427/248.1, 239, 427/237, 238, 314; 34/443

[56] References Cited

U.S. PATENT DOCUMENTS

| | | | |
|---|---|---|---|
| 3,762,938 | 10/1973 | Ridenour et al. | 117/63 |
| 4,063,974 | 12/1977 | Fraas | 148/175 |
| 4,590,091 | 5/1986 | Rodgers, Jr. et al. | 427/53.1 |
| 4,604,168 | 8/1986 | Liu et al. | 204/30 |
| 4,714,632 | 12/1987 | Cabrera et al. . | |
| 5,104,694 | 4/1992 | Saito et al. | 427/255 |
| 5,255,445 | 10/1993 | Li et al. | 34/22 |

FOREIGN PATENT DOCUMENTS

| | | | |
|---|---|---|---|
| 1530337 | 10/1978 | United Kingdom . | |
| 2107360 | 4/1983 | United Kingdom | C23C 11/06 |
| 89/12887 | 12/1989 | WIPO . | |

*Primary Examiner*—Roy V. King

*Attorney, Agent, or Firm*—Oblon, Spivak, McClelland, Maier, & Neustadt

[57] ABSTRACT

A process for passivating a metal surface to enhance the stability of a gas mixture containing one or more gaseous hydrides in low concentration in contact therewith, which comprises:

a) purging gas in contact with said metal surface with inert gas to remove the purged gas, b) exposing the metal surface to an amount of a gaseous passivating agent comprising an effective amount of a gaseous hydride of silicon, germanium, tin or lead and for a time sufficient to passivate said metal surface, and c) purging said gaseous passivating agent using inert gas.

18 Claims, 1 Drawing Sheet

PROCESS FOR PASSIVATING METAL SURFACES TO ENHANCE THE STABILITY OF GASEOUS HYDRIDE MIXTURES AT LOW CONCENTRATION IN CONTACT THEREWITH

This application is a continuation of application Ser. No. 08/215,016, filed on Mar. 21, 1994, which is a continuation of application Ser. No. 07/709,183, filed on Jun. 3, 1991, both of them are now abandoned.

BACKGROUND OF THE INVENTION

1.Field of the Invention

The present invention relates to a process for passivating metal surfaces to enhance the stability of gaseous hydride mixtures at low concentration in contact therewith.

2. Description of the Background

In the electronics industry, and in view of environmental considerations, there is an important need for stable gas mixtures containing low concentrations of gaseous hydrides in the ppb to ppm range. The standard practice in industry is to prepare such mixtures in compressed gas cylinders, in which such mixtures are often stored for extended periods of time. However, due to reactions between gas mixtures containing such amounts of gaseous hydrides and the metal surfaces of containers containing these mixtures, it is very difficult to stabilize the same.

One approach to overcoming this instability and to maintaining a constant gas mixture concentration is to minimize the contact time between the low concentration hydrides and metal containers by storing a high concentration mixture in the cylinder and then diluting immediately before use. Unfortunately, however, in many instances, it is desirable, if not necessary, to store the gas mixtures in metal cylinders for extended periods of time.

Another approach for maintaining a constant gas mixture concentration of low concentration hydrides is saturation passivation. In this technique, the container is subjected to several cycles of evacuating and filling with a much higher concentration of the same gaseous hydride, prior to being filled with the low concentration hydride mixture of interest. This procedure is repeated several times based upon previous empirical studies. This technique is of limited usefulness, however, as a higher concentration of the same hydride must be used for conditioning the container, and it is very disadvantageous to handle large amounts of toxic gases, such as arsine, during the process.

Thus, a need continues to exist for a passivation process which is suitable for stabilizing gaseous hydride mixtures, which avoids the drawbacks of the conventional approaches described above.

SUMMARY OF THE INVENTION

Accordingly, it is an object of the present invention to provide a process for passivating a metal surface to enhance the stability of a gas mixture containing gaseous hydrides in low concentration in contact therewith.

It is also an object of this invention to provide a process for passivating a metal surface, which is advantageous for treating any metal surface, particularly those which are used to make gas storage cylinders, conduits, containers, pipes, tank truck storage rigs or railroad tank storage cars, for example.

It is, in particular, an object of the present invention to provide a process for passivating a metal surface, which is particularly advantageous for treating metal compressed gas storage cylinders.

The above objects and others which will become more apparent in view of the following are provided by a process for passivating a metal surface to enhance the stability of a gas mixture containing gaseous hydrides in low concentration in contact therewith, which entails:

a) purging gas in contact with said metal surface with inert gas to remove the purged gas, b) exposing the metal surface to an amount of a gaseous passivating agent comprising an effective amount of a gaseous hydride of silicon, germanium, tin or lead, and for a time sufficient to passivate said metal surface, and c) purging the passivating agent using inert gas.

DETAILED DESCRIPTION OF THE PREFERRED EMBODIMENTS

Figure 1:
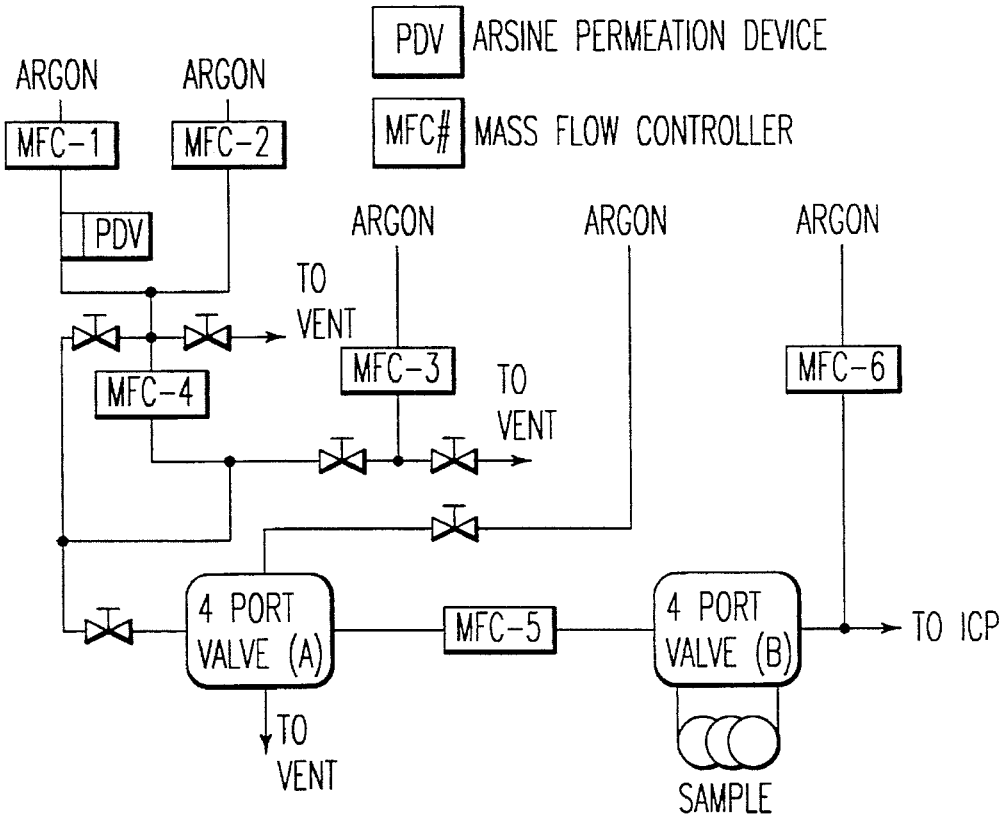
FIG. 1 illustrates a schematic diagram of a flow system in accordance with the present invention.

In accordance with the present invention, a process is provided for passivating a metal surface to enhance the stability of a gas mixture containing gaseous hydrides in low concentration in contact therewith, such as arsine, phosphine or stibine.

At present, passivation is used to improve the corrosion resistance of metal particles and steel surfaces for very particular applications. For example, WO 89/12887 describes a silane passivation process on metal particles, which improves the corrosion resistance against metallic oxidation, and GB 2,107,360 B describes a silane passivation process for steel surfaces for improving corrosion resistance in a carbon dioxide-rich environment at high temperature and pressure. However, neither of these disclose or suggest a process for stabilizing a gas mixture composition as in the present invention.

In accordance with the present process, any metal surface may be treated so as to enhance the stability of gas mixtures containing gaseous hydrides in low concentration in contact therewith. The metal surface may be, for example, metal tubing, metal valves or metal compressed gas storage cylinders. However, any type of metal surface may be so treated.

For example, in accordance with the present invention, any metal may be passivated, in particular those which are useful in making gas storage cylinders, conduits, containers, pipes and any type of storage means including railroad tank storage cars and tank truck trailer rigs. For example, metals such as iron, steel and aluminum may be passivated in accordance with the present invention.

The present invention may, for example, be advantageously used in the treatment of various steels and alloys thereof, such as ferrite steels, austenitic steels, stainless steels and other iron alloys, and is particularly advantageous in the treatment of stainless steels. However, other types of metals may be so treated.

Generally, the present invention is used to passivate a metal surface using relatively non-toxic gaseous hydrides to enhance the stability of gas mixtures containing gaseous hydrides in low concentration.

As used herein, the term "relatively non-toxic gaseous hydrides" includes the silicon hydrides, germane hydrides, tin hydrides and lead hydride. The toxic gaseous hydrides such as arsine or phosphine are avoided.

Of particular usefulness are silicon hydrides of the general formula $Si_n H_{2n+2}$, such as $SiH_4$, $Si_2H_6$ and $Si_6H_{14}$. However, other hydrides such as $Ge_2H_6$, $Ge_9H_{20}$, $SnH_4$, $SnH_6$ or $PbH_4$ may be used.

In the above formula for silicon hydrides, n is generally from 1 to about 10. However, n can be a higher value as silicon hydrides are known to exhibit catenation. See *Advanced Inorganic Chemistry,* Cotton and Wilkinson, Third Edition.

As used herein, the phrase "gaseous hydrides in low concentration" generally means gaseous hydrides of a concentration of from about 10 ppb to about 10 ppm. More preferably, the concentration is about 50 ppb to about 5 ppm. Most preferably, however, the concentration about 100 ppb to about 1 ppm.

In accordance with the present invention in order to passivate a metal surface to enhance the stability of a gas mixture containing gaseous hydrides in low concentration in contact therewith, it is first necessary to purge the gas or gas mixture initially in contact with the metal surface with inert gas to remove the purged gas. As an inert purging gas, any gas which is generally chemically non-reactive may be used. For example, the so-called noble gases, such as krypton, xenon, helium, neon and argon may be used. However, other gases such as hydrogen and nitrogen may be used. Generally, the inert purging gas will be passed over the metal surface for a time and in an amount sufficient to remove substantially all of the purged gas. Typically, the purging gas is passed over the metal surface, or through a volume defined by a continuous metal surface, such as a compressed gas storage cylinder, for anywhere from several seconds to up to about 30 minutes at from 1 to about 3 atmospheres of pressure. However, higher pressures may be used, if desired.

In accordance with the present invention, nitrogen has been found to be advantageous as an inert purging gas, although other inert gases may be used.

After purging the gas in contact with the metal surface, the metal surface is then exposed to an amount of passivating agent containing an effective amount of one or more gaseous hydrides of silicon, germanium, tin or lead, and for a time sufficient to passivate the metal surface.

Generally, the higher the concentration of passivating agent used, such as silane, the shorter the exposure time required. However, passivating agent concentrations of as low as 1 ppm may be used, or as high as 100%. For example, if a very low concentration of silane is used, exposure times in excess of 80 hours are usually required. Generally, exposure times of about 100 hours are typically used for dilute passivating agents. However, if relatively pure passivating agent is used, for example, generally less than 60 minutes exposure time is required, preferably less than 30 minutes.

As described above, the phrase "pure passivating agent" means that the passivating agent used is the pure gaseous hydride of one or more silicon, germanium, tin or lead.

While any concentration of passivating agent may be used, it is generally desirable to use a concentration in the range of about 0.01% to 20% by volume. It is preferred, however, to use a concentration in the range of about 0.01% to 5% by volume. With such concentrations, an exposure time of from about 1 to 24 hours is generally required. Generally, for larger metal surfaces, such as vessels, larger volumes of passivating agent may be used.

In accordance with the present invention, substantially all of the purged gas is displaced or removed by the inert gas.

As used herein, the phrase "substantially all of the purged gas" means that the purged gas is removed to an extent of above 99% by volume.

Generally, the purged gas is air, however, other gases or gas mixtures, such as mixtures mainly containing nitrogen and oxygen, may be purged in accordance with the present invention.

Generally, the exposure of the metal surface to the passivating agent may be effected at from very low temperatures of about −20° C. to up to right below the gaseous hydride decomposition temperature of the one or more gaseous hydrides in the passivating agent. For example, the decomposition temperature of silane is 250° C. However, it is generally preferable to effect the exposure at from about 10° C. to about 100° C. It is more preferable to effect the passivating agent exposure at from about 20° C. to about 50° C. However, it is most advantageous to effect the exposure at about 25° C.

Although the exposure may be effected at high temperatures, the gas phase reaction of the one or more gaseous hydride of the passivating agent, such as silane, is preferably kept to a minimum to avoid the formation of particles. Generally, this means at a temperature of less than the passivating agent gaseous hydride decomposition temperature.

After subjecting the metal surface to treatment with passivating agent, the latter is, itself, purged with an inert purging gas, such as nitrogen. However, the noble gases as described above may be used.

The present invention also provides an optional fourth step in which the metal surface is then exposed to an oxidizing gas in order to stabilize the adsorbed passivating agent on the metal surface. As an oxidizing gas, gas mixtures containing nitrogen and oxygen may be used, for example.

Generally, oxidizing gas mixtures may be used which are capable of oxidizing the adsorbed passivating agents to an inert oxidized form. For example, gas mixtures containing from about 1 to 10% volume of oxygen in nitrogen may be advantageously used when using such mixtures to oxidize the adsorbed passivating agent, metal surface exposure times of film about 30 sec. to about 3 minutes are generally used. However, shorter or longer exposure times may be used as required.

In general, the oxidation step may be effected at the same temperatures as used for the passivation step, with temperatures of from about 10° C. to about 100° C. being preferred, and with temperatures of from 20° C. to about 50° C. being most preferred.

In accordance with this aspect of the present invention it has been discovered that adsorbed gaseous hydride may be desorbed very slowly over a period of time thus reducing the effectiveness of the passivation treatment over time. By oxidizing the adsorbed passivating agent containing a gaseous hydride, such as silane, for example, an inert compound, such as $SiO_2$, may be formed. Hence, the oxidation step provides a means to stabilize the passivated metal surface for long term use.

Figure 2:
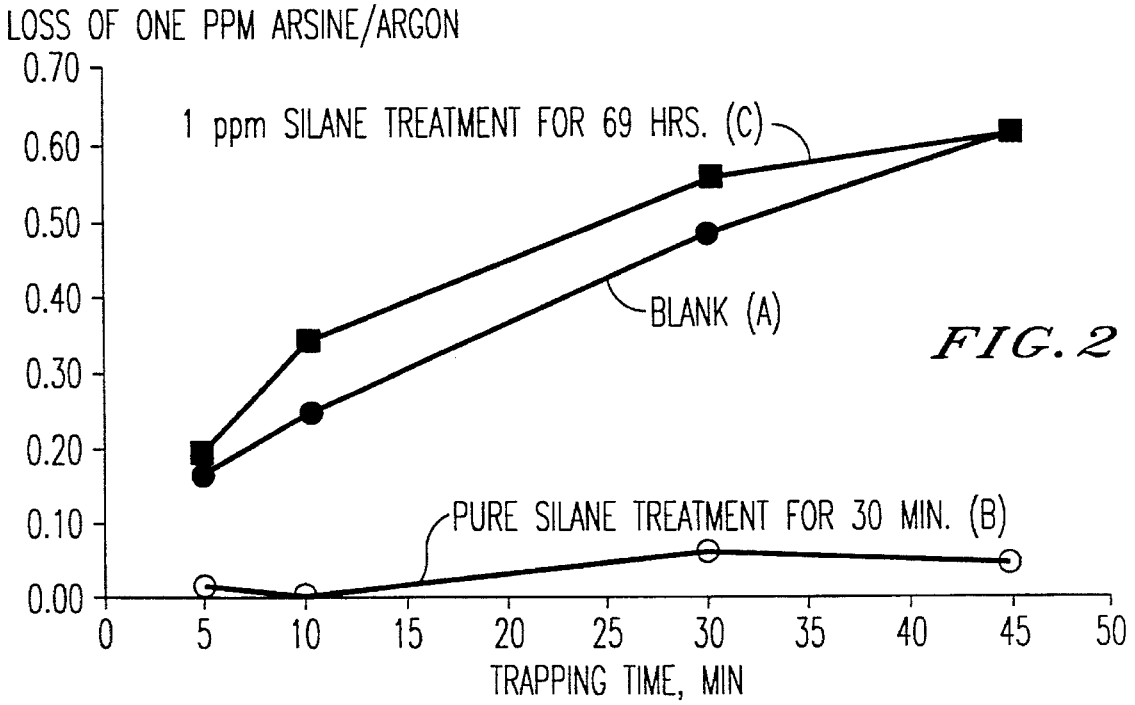
FIG. 2 graphically illustrates the relationship between trapping time and loss of 1 ppm $AsH_3$/Ar in 316 L stainless steel tubing.

FIGS. 1 and 2 will now be described in more detail.

FIG. 1 provides a schematic flow diagram using mass flow controllers, an arsine permeation device, valves and port valves A and B in fluid connection. This apparatus is conveniently used to test the stability of gaseous hydrides, as measured by an inductively coupled plasma spectrophotometer. However, other detection means known to those skilled in the art may be used instead.

FIG. 2 illustrates a summary of stability data from samples A, B and C as defined hereinbelow in the example. In particular, the 1 ppm treatment (sample C) failed to passivate the metal surface after 69 hours of exposure. Generally, at such low concentrations, in excess of 70 hours of exposure is required, preferably at least 80 hours of exposure.

The pure silane treatment (sample B) effected surface passivation in less than 30 minutes of exposure. Sample A is a controlled sample.

Generally, in accordance with the present invention, the gaseous hydride treatment is effected to passivate substantially all of the metal surface. As used herein, the term "substantially all" means that at least 90% of the metal surface in contact with the gaseous hydride is passivated. However, it is preferred if at least 99% of the metal surface in contact with the gaseous hydride is passivated. It is particularly preferred if at least 99.9% of the metal surface in contact with the gaseous hydride is passivated.

The present invention will now be further illustrated by reference to certain examples which are provided for purposes of illustration and are not intended to be limitative.

EXAMPLE

In order to demonstrate the effect of the present invention on metal surfaces, a ¼" ID stainless steel tube was used.

Three identical samples (A, B and C) of ¼" ID stainless steel tubings were exposed to ambient air under the conditions typical in the preparation of gas handling and storage equipment. It is known that under such exposure conditions, the stability of mixtures is very poor. All of the samples were then purged with dry $N_2$ gas at room temperature. Sample A served as a controlled sample. Sample B was then treated with flowing pure silane for 30 minutes at room temperature and sample C was purged with 1 ppm silane for 72 hours, followed by purging with dry air, according to the conditions described below.

The stability of hydrides in the so prepared samples A, B and C was tested in a setup as shown in FIG. 1. The tube was filled with argon gas containing 1 ppm arsine. This gas was kept in the tube by means of a valve as shown in FIG. 1 for various periods of time. After that, the gas was introduced into a device capable of measuring the concentration of hydride remaining in the gas. In this example, the device is an inductively coupled plasma spectrophotometer. However, other detection means may be used. The ratio of initial fill concentration to final concentration was used to measure the gas stability. The results for a typical test with arsine are shown in FIG. 2.

Additionally, the present invention also provides storage means for a gas or gas mixture, which means at least has an interior metal surface thereof which has been passivated. However, the storage means may be completely made of metal. Preferably, the storage means is compressed gas storage cylinder. However, the storage means may be a mobile storage means, such as a tank tractor trailer rig or a railroad tank car.

Thus, the present invention provides storage means having at least an interior metal surface thereof which is passivated, thereby enhancing the stability of a gas mixture containing one or more gaseous hydrides in low concentration when in contact therewith. As used herein, the term "passivated" means that the internal metal surface of the storage means has been subjected to the present passivation process and is thus unable to react with gases or gas mixtures stored therein which contain low concentrations of gaseous hydrides. In accordance with the present invention, it is advantageous if the passivating agent used is a silicon hydride of the formula $Si_n H_{2n+2}$, wherein n is about 1–10, more preferably n is 1.

It is, however, particularly preferred if the passivated storage cylinder whose internal surface has been passivated with gaseous hydride passivating agent in accordance with the present process.

Having described the present invention, it will now be apparent to one of ordinary skill in the art that many changes and modifications may be made to the above embodiments without departing from the spirit and the scope of the present invention.

What is claimed as new and desired to be secured by letters patent of the United States is:

1. A process for enhancing stability of a stored gas mixture containing one or more gaseous hydrides selected from the group consisting of phosphine, arsine, and stibine, in contact with a metal surface, which comprises:

a) purging a first gas in contact with said metal surface with a second inert gas to remove said first gas;

b) exposing the metal surface to a passivating agent comprising an amount of a gaseous hydride of silicon, germanium, tin or lead sufficient for passivating substantially all of said metal surface to be in contact with said stored gas mixture, and for a time sufficient to form a passivated surface on substantially all of said metal surface, said metal surface being exposed to said passivating agent at a temperature up to about 100° C.;

c) purging said passivating agent with said second inert gas; and d) contacting said passivated metal surface with said stored gas mixture, whereby stability of said stored gas mixture is enhanced.

2. The process of claim 1, wherein said metal surface comprises steel, iron or aluminum.

3. The process of claim 1, wherein said metal surface is a continuous metal surface of a compressed gas storage cylinder.

4. The process of claim 1, wherein said inert gas is nitrogen, argon, krypton, xenon or neon.

5. The process of claim 1, which further comprises, after step c) exposing the metal surface to an oxidizing gas or gas mixture in an amount and for a time sufficient to stabilize absorbed passivating agent.

6. The process of claim 1, wherein said gaseous hydride passivating agent is selected from the group consisting of a silicon hydride of the formula $Si_nH_{2n+2}$, wherein n is 1 to about 10; $Ge_2H_6$, $Ge_9H_{20}$, $SnH_4$, $SnH_6$ and $PbH_4$.

7. The process of claim 6, wherein said gaseous hydride passivating agent is a silicon hydride of the formula $Si_nH_{2n+2}$, wherein n is from 1 to about 10.

8. The process of claim 7, wherein said silicon hydride is $SiH_4$.

9. The process of claim 2, wherein said steel is selected from the group consisting of ferrite steel, austenite steel and stainless steel.

10. The process of claim 1, wherein said metal surface is a surface of a pipe, railroad tank storage car or a tank truck trailer.

11. The process of claim 1, wherein said one or more gaseous hydrides are present in said gas mixture in an amount of from about 10 ppb to about 10 ppm thereof.

12. The process of claim 11, wherein said one or more gaseous hydrides are present in said gas mixture in an amount of from about 50 ppb to about 5 ppm thereof.

13. The process of claim 12, wherein said one or more gaseous hydrides are present in said gas mixture in an amount of from about 100 ppb to about 1 ppm thereof.

14. The process of claim 1, wherein said metal surface is exposed to said passivating agent at a temperature of from about 20° C. to about 50° C.

15. The process of claim 1, wherein said metal surface is exposed to said passivating agent at a pressure of from about 1 to 3 atmospheres.

16. The process of claim 5, wherein said exposure of said metal surface to said oxidizing gas or gas mixture is effected at a temperature of from about 10° C. to about 100° C.

17. The process of claim 10, wherein said temperature is about 20° C. to about 50° C.

18. The process of claim 1, wherein said first gas purged in contact with said metal surface is air.

* * * * *